US006301929B1

(12) United States Patent
Lochner

(10) Patent No.: US 6,301,929 B1
(45) Date of Patent: Oct. 16, 2001

(54) PROCESS AND APPARATUS FOR PRODUCING PRESSURIZED OXYGEN AND KRYPTON/XENON BY LOW-TEMPERATURE FRACTIONATION OF AIR

(75) Inventor: Stefan Lochner, Grafing (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 09/452,167

(22) Filed: Dec. 1, 1999

(30) Foreign Application Priority Data

Dec. 1, 1998 (DE) ..... 198 55 487

(51) Int. Cl.[7] ..... F25J 3/04
(52) U.S. Cl. ..... 62/643
(58) Field of Search ..... 62/643, 646, 925

(56) References Cited

U.S. PATENT DOCUMENTS 3,222,879 12/1965 Stoklosinski .
5,067,976 * 11/1991 Agrawal et al. ..... 62/22
5,122,173 * 6/1992 Agrawal et al. ..... 62/22
5,309,719 * 5/1994 Agrawal et al. ..... 62/22

FOREIGN PATENT DOCUMENTS 4332870 3/1995 (DE) .
8706684 11/1987 (WO) .

* cited by examiner

*Primary Examiner*—William Doerrler
*Assistant Examiner*—Malik N. Drake
(74) *Attorney, Agent, or Firm*—Millen, White, Zelano & Branigan, P.C.

(57) ABSTRACT

The process and the apparatus serve for producing pressurized oxygen and krypton/xenon by low-temperature fractionation of air. The rectifying system has a low-pressure column (3) for the nitrogen-oxygen separation and a krypton-xenon enrichment column (15). Compressed and prepurified feed air (4) is introduced into the rectifying system. A first oxygen fraction (11) is taken off from the low-pressure column (3), brought (12) to an elevated pressure in the liquid state, vaporized and removed as gaseous pressurized oxygen product (24). In addition, a second oxygen fraction (16) is taken off from the low-pressure column (3) and passed (18) into the lower or central region of the krypton-xenon enrichment column (15). The first oxygen fraction (11) is taken off at least one actual or theoretical plate above the bottom of the low-pressure column (3) and, after the pressure elevation (12) is introduced (14) in the liquid state into the upper region of the krypton-xenon enrichment column (15). A krypton-enriched and/or xenon-enriched fraction (19) is taken off from the lower region of the krypton-xenon enrichment column (15). The pressurized oxygen product (24) is withdrawn in the gaseous state from the upper region of the krypton-xenon enrichment column (15).

10 Claims, 1 Drawing Sheet

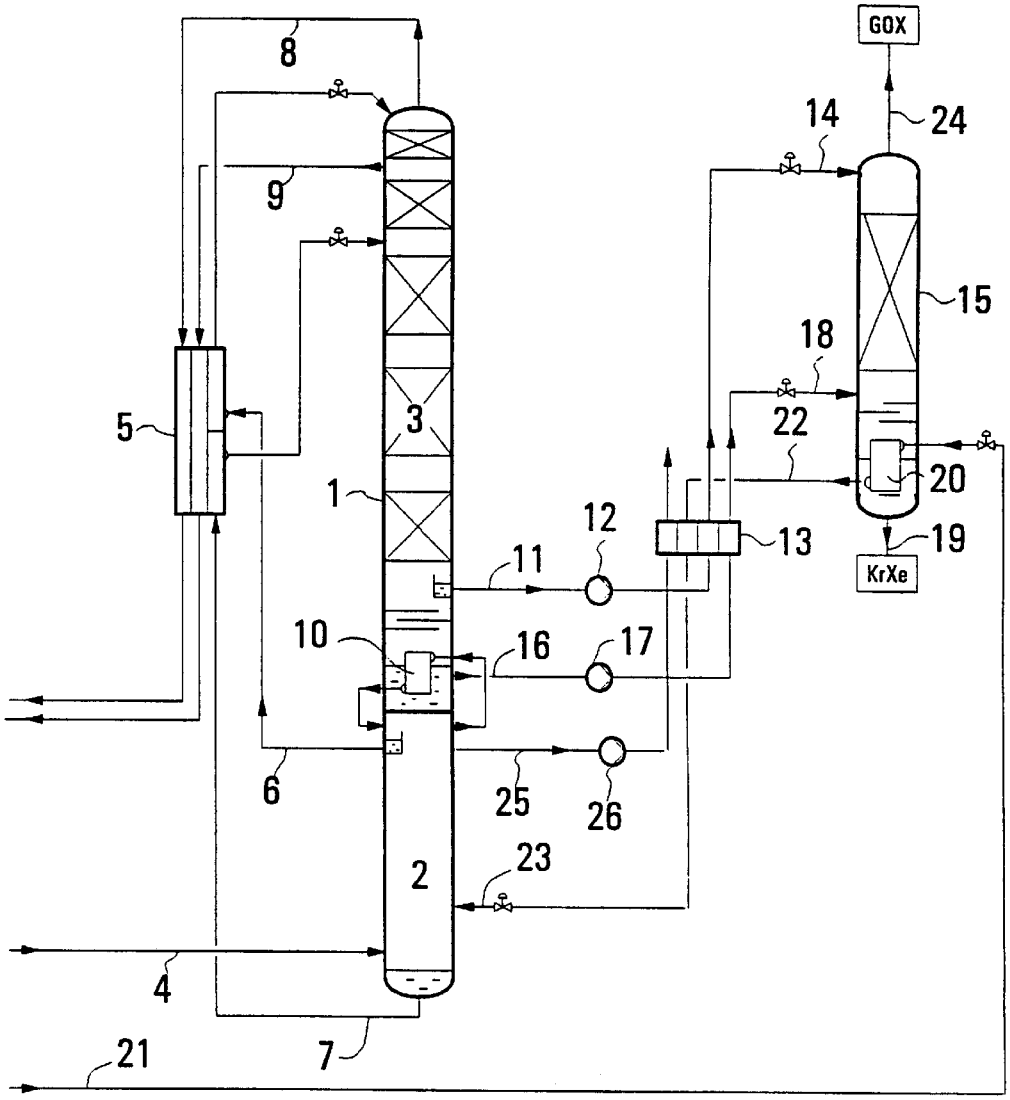
GOX
8
14
24
9
15
18
5
3
22
20
1
12
13
19
11
KrXe
10
16
17
6
25
26
2
23
4
21
7

PROCESS AND APPARATUS FOR PRODUCING PRESSURIZED OXYGEN AND KRYPTON/XENON BY LOW-TEMPERATURE FRACTIONATION OF AIR

The invention starts from a process for producing pressurized oxygen in which compressed and prepurified feed air is introduced into the rectifying system and a first oxygen fraction is taken off from the low-pressure column, brought to an elevated pressure in the liquid state, vaporized and removed as gaseous pressurized oxygen product.

Processes of this type for producing gaseous pressurized oxygen has long been known (see for example DE 880893). The pressure elevation in the liquid product with subsequent vaporization is frequently called "internal compression". DE 19529681 A and EP 716280 A show relatively recent examples of such processes.

The object underlying the invention is, in a process of this type and in a corresponding apparatus, to produce in addition to the pressurized oxygen product, a krypton- and xenon-enriched product in an economically expedient manner.

In the methods for krypton/xenon production known to date, the bottoms fraction of the low-pressure column (the second oxygen fraction) is introduced into a krypton-xenon enrichment column (methane ejection column), to the top of which is applied low-krypton/xenon liquid oxygen. By this means the methane which collects in the bottoms of the low-pressure column can be removed from the process via the gaseous overhead product of the methane ejection column. The bottoms product of the methane ejection column contains only extremely low amounts of methane and is enriched in krypton and xenon. It can either be withdrawn directly as krypton/xenon preconcentrate from the methane ejection column or recirculated into the low-pressure column and from there withdrawn as preconcentrate. This mode of operation is known per se and is described for example in Hausen/Linde, Tieftemperaturtechnik [Cryogenics], 2nd edition, 1985, pages 337 ff. and in DE 4332870 A1.

In the present invention, the krypton/xenon enrichment column (which if appropriate acts as methane ejection column) is operated at an elevated pressure which preferably approximately corresponds to the desired product pressure in the pressurized oxygen. The operating pressure of the krypton-xenon enrichment column is, for example, 1.5 to 10 bar, preferably 2.5 to 7 bar. The liquid oxygen from which the pressurized oxygen product is formed (the first oxygen fraction) is not withdrawn as is customary at its bottom, but above a mass-transfer section which retains krypton and xenon in the bottoms of the low-pressure column. The mass-transfer section forms the low-krypton/xenon reflux liquid for the krypton-xenon enrichment column. With regard to the production of pressurized oxygen, the oxygen is vaporized, instead of the indirect evaporation which is customary in internal compression processes, by direct heat exchange with the vapour ascending in the krypton-xenon enrichment column. The vaporized first oxygen fraction is withdrawn as overhead vapour of the krypton-xenon enrichment column, heated to ambient temperature and removed as pressurized oxygen product. The mass-transfer section below the takeoff of the first oxygen fraction is formed by at least one, preferably 1 to 5, most preferably 1 to 3, rectifying plates which are disposed directly above the low-pressure column bottoms.

Preferably, in the invention a two- or multicolumn system is used for the nitrogen-oxygen separation, which system, in addition to the low-pressure column also has a high-pressure column which is operated at a higher pressure than the low-pressure column. Preferably, high-pressure column and low-pressure column are thermally coupled via a shared condenser-evaporator (main condenser), in which nitrogen-rich vapour of the high-pressure column is condensed against a vaporizing oxygen-rich liquid from the low-pressure column. However, the invention can also be implemented with a single-column system in which the low-pressure column is formed by an individual column. The use of the term low-pressure column does not necessarily mean that this column is operated at about atmospheric pressure. Not only in the case of single-column processes, but also with double-column and multicolumn processes, the low-pressure column can also be operated at elevated pressure. The operating pressure of the low-pressure column is for example 1.1 to 4 bar, preferably 1.1 to 2.0 bar. The krypton-xenon enrichment column is operated below the critical pressure of oxygen, depending on the product pressure for example at 2 to 10 bar, preferably at 5 to 6 bar.

The first oxygen fraction is not taken off directly at the bottom of the low-pressure column, but at least one actual or theoretical plate above the bottom or above the takeoff of the second oxygen fraction. (In the event that in the respective section only actual plates are used as mass-transfer elements, the specifications apply as actual numbers of plates; if arranged packing, random packing or combinations of different types of mass-transfer elements are used, the specifications must be employed as theoretical numbers of plates.) For pressure elevation in the liquid state, any known means or a combination of different known means can be used.

In comparison with a simple combination of known internal compression processes, in which the first oxygen fraction is withdrawn from bottoms of the low-pressure column, with known processes for krypton/xenon production using a krypton/xenon enrichment column (methane ejection column), in the process of the invention, the yield of krypton and/or xenon is increased by 20 to 25%.

The second oxygen fraction, before it is introduced into the krypton-xenon enrichment column, must be brought to its operating pressure. Preferably, the second oxygen fraction, before it is introduced into the krypton-xenon enrichment column, is brought, however, in the liquid state to an elevated pressure and thereafter introduced in the liquid state into the krypton-xenon enrichment column.

Especially in the case of liquid introduction of the second oxygen fraction into the krypton-xenon enrichment column, this requires a bottoms evaporator. It is expedient if this is operated by indirect heat exchange with a partial stream of the feed air. Preferably, the feed air condenses at least partially in the bottoms evaporator. The condensate produced in the indirect heat exchange is introduced, for example, into one of the columns of the rectifying system, preferably into the low-pressure column.

Preferably, the feed air used as heating medium is brought upstream of the bottoms evaporator to a pressure which is higher than the highest operating pressure of the rectifying system columns. This pressure is chosen so that the condensation temperature of the feed air in the bottoms evaporator is, for example, about 1 to 2 K above the evaporation temperature of the bottoms liquid of the krypton-xenon enrichment column. This can be effected, for example, by all of the feed air being compressed to a very high pressure (for example to above the high-pressure column pressure in the case of a double-column system) or by the partial stream used as heating medium being recompressed from a lower level (for example high-pressure column pressure) to this high pressure.

BRIEF DESCRIPTION OF THE DRAWING

The invention and other details of the invention are described in more detail below with reference to an illustrative example shown in the drawing.

DETAILED DESCRIPTION OF THE DRAWING

A first feed air stream which was compressed to 6 bar and then purified and cooled to about dew point, enters via line 4 into the high pressure column 2 of a double-column 1. Nitrogen 6 and crude oxygen 7, after subcooling in a first counter-current flow heat exchanger 5, are fed at least in part into the low-pressure column 3 (operating pressure 1.2 to 1.7 bar, preferably 1.2 to 1.4 bar). High-pressure column and low-pressure column are in a heat-exchange relationship via a condenser-evaporator 10. From the upper region of the low-pressure column 3, pure and impure nitrogen 8, 9 are taken off as products and heated in the counter-current flow heat exchanger 5 and in the main heat exchanger which is not shown. (Other possible inlets, for example for the direct feed of air into the low-pressure column or for connection to a crude argon column are not shown in the drawing.) The operating pressures of high-pressure column and low-pressure column are, in the example, 5.5 bar and 1.3 bar, respectively, at the top.

A first oxygen fraction 11 is taken off in the liquid state three plates above the low-pressure column bottom, brought by means of a pump 12 to a pressure of 9 bar, subcooled in a second counter-current flow heat exchanger and applied via line 14 to the top of a krypton-xenon enrichment column 15. Via line 16, bottoms liquid is taken off from the low-pressure column (second oxygen fraction), brought to 9 bar in a second pump 17, likewise cooled in the second counter-current flow heat exchanger 13 and fed (line 18) to the krypton-xenon enrichment column 15 at an intermediate point. The feed point, in the example, is three plates above the bottom of the krypton-xenon enrichment column 15.

A krypton-xenon preconcentrate 19 is withdrawn as krypton-enriched and/or xenon-enriched fraction from the bottom of the krypton-xenon enrichment column 15. The preconcentrate can be collected in a tank or fed directly to other process steps for producing krypton and/or xenon. The overhead gas 24 of the krypton-xenon enrichment column 15 forms the pressurized oxygen product and is heated in the main heat exchanger against feed air (not shown).

The krypton-xenon enrichment column 15 is heated by indirect heat exchange 20 with a second purified and cooled feed air stream 21 which is at a pressure of 22 bar. The resultant condensate 22 is heated in the second counter-current flow heat exchanger 13 and passed (23) to the high-pressure column 2 some plates above the feed-in point of the first feed air stream 4.

If nitrogen is to be produced as high-pressure product, a part 25 of the overhead nitrogen of the high-pressure column 2 can be pressurized in the liquid state in a pump 26 and conducted through the second counter-current flow heat exchanger 13.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding German application 19855487.7, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for producing pressurized oxygen and krypton/xenon by low-temperature fractionation of air in a rectifying system which has a low-pressure column (3) for nitrogen-oxygen separation and a krypton-xenon enrichment column (15), said process comprising the following steps wherein:

compressed and prepurified feed air (4, 21, 22, 23) is introduced into the rectifying system and a first oxygen fraction (11) is taken off from the low-pressure column (3), brought (12) to an elevated pressure in the liquid state, vaporized and removed as gaseous pressurized oxygen product (24), in which, in the process, in addition a second oxygen fraction (16) is taken off from the low-pressure column (3) and passed (18) into the lower or central region of the krypton-xenon enrichment column (15), the first oxygen fraction (11) is taken off at least one actual or theoretical plate above the bottom of the low-pressure column (3) and, after the pressure elevation (12) is introduced (14) in the liquid state into the upper region of the krypton-xenon enrichment column (15), at least one of a krypton-enriched and xenon-enriched fraction (19) is taken off from the lower region of the krypton-xenon enrichment column (15) and the pressurized oxygen product (24) is withdrawn in the gaseous state from the upper region of the krypton-xenon enrichment column (15).

2. A process according to claim 1, comprising bringing (17) the second oxygen fraction (11), upstream of its introduction (18) into the krypton-xenon enrichment column (15) to an elevated pressure in the liquid state.

3. A process according to claim 2, in which the krypton-xenon enrichment column (15) has a bottoms evaporator (20) and comprising passing feed air (21) as heating medium into the bottoms evaporator (20).

4. A process according to claim 3, comprising bringing the feed air (21) used as heating medium is, upstream of the bottoms evaporator (20) to a pressure which is higher than the highest operating pressure of the columns (2, 3 15) of the rectifying system.

5. A process according to claim 1, in which the krypton-xenon enrichment column (15) has a bottoms evaporator (20) and comprising passing feed air (21) as heating medium into the bottoms evaporator (20).

6. A process according to claim 5, comprising bringing the feed air (21) used as heating medium, upstream of the bottoms evaporator (20) to a pressure which is higher than the highest operating pressure of the columns (2, 3, 15) of the rectifying system.

7. Apparatus for producing pressurized oxygen and krypton/xenon by low-temperature fractionation of air comprising a rectifyng system comprising a low-pressure column (3) for nitrogen-oxygen separation and a krypton-xenon enrichment column (15), and having a feed air line (4) for introducing compressed and prepurified feed air into the rectifying system, a first oxygen line (11, 14) for withdrawing a first oxygen fraction as liquid from the low-pressure column (3), which line has means (12) for elevating the pressure of the first oxygen fraction in the liquid state and is connected downstream of the means for pressure elevation to a means for evaporating the first oxygen fraction which has been pressurized in the liquid state, a pressurized product line (24) connected to the evaporation means, a second oxygen line (16, 18) for withdrawing a second oxygen fraction from the low-temperature column (3) being connected to the lower or central region of the krypton-xenon enrichment column (15), in the low-pressure column (3) being disposed between the first oxygen line (11) and the bottom of said low-pressure column, a mass-transfer section which comprises at least one actual or theoretical plate, said evaporation means for evaporating the first oxygen fraction being incorporated in the krypton-xenon enrichment column (15), wherein the first oxygen line (11, 14) is connected to the upper region of the krypton-xenon enrichment column (15), a preconcentrate line (19) for withdrawing at least one of a krypton-enriched and xenon-enriched fraction, being connected to the lower region of the krypton-xenon enrichment column (15) and the pressurized product line (24) being connected to the upper region of the krypton-xenon enrichment column (15).

8. Apparatus according to claim 7, in which the second oxygen line, upstream of the krypton-xenon enrichment column, possesses a means for increasing the pressure of the second oxygen fraction in the liquid state.

9. Apparatus according to claim 8, in which the krypton-xenon enrichment column has a condenser-evaporator as bottoms evaporator, the condensation space of which is connected to a heating medium line for introducing a heating medium.

10. Apparatus according to claim 7, in which the krypton-xenon enrichment column has a condenser-evaporator as bottoms evaporator, the condensation space of which is connected to a heating medium line for introducing a heating medium.

* * * * *